US006648627B2

(12) United States Patent
Dane

(10) Patent No.: US 6,648,627 B2
(45) Date of Patent: Nov. 18, 2003

(54) GAS APPLIANCE WITH A BURNER IN THE LOWER PART, EQUIPPED WITH SAFETY MEANS, AND RESULTING WATER HEATER

(75) Inventor: Bernard Dane, Montbazon (FR)

(73) Assignee: Sourdillon (FR)

( * ) Notice: Subject to any disclaimer, the term of this patent is extended or adjusted under 35 U.S.C. 154(b) by 0 days.

(21) Appl. No.: 10/237,771

(22) Filed: Sep. 9, 2002

(65) Prior Publication Data

US 2003/0049574 A1 Mar. 13, 2003

(30) Foreign Application Priority Data

Sep. 10, 2001 (FR) ..... 01 11668
Oct. 30, 2001 (FR) ..... 01 14021
Apr. 9, 2002 (FR) ..... 02 04401

(51) Int. Cl.[7] ..... F23N 5/24; F23N 5/00; F23N 5/10

(52) U.S. Cl. ..... 431/22; 431/76; 431/80

(58) Field of Search ..... 431/22, 76, 80, 431/278

(56) References Cited

U.S. PATENT DOCUMENTS 4,395,226 A * 7/1983 Nakanishi et al. ..... 431/76
4,544,348 A * 10/1985 Boij ..... 431/146
4,924,816 A * 5/1990 Moore et al. ..... 122/17.1
4,995,415 A 2/1991 Weber
5,797,355 A * 8/1998 Bourke et al. ..... 122/14.21
6,139,311 A * 10/2000 Bowman et al. ..... 431/278

FOREIGN PATENT DOCUMENTS

EP 0100758 2/1984

* cited by examiner

*Primary Examiner*—Alfred Basichas
(74) *Attorney, Agent, or Firm*—Piper Rudnick

(57) ABSTRACT

The invention relates to a gas appliance (1), with a gas burner (4) in the lower part of the said appliance and in the vicinity of an underlying surface (6), further comprising: an atmosphere control pilot light (12) fitted with a primary air inlet orifice connected to which is a tube (10), the free orifice (11) of which is located below the gas burner (4); and means (12) for detecting the temperature of the flame (15) of the pilot light which are operationally coupled to means (14) for cutting off the gas supply to the main burner (4); whereby the gas supply to the burner is interrupted when cooling of the flame of the pilot light, caused by gas enrichment of the mixture (vapors in the primary air, air intake obstructed by a liquid phase) is detected.

11 Claims, 6 Drawing Sheets

FIG.3A.
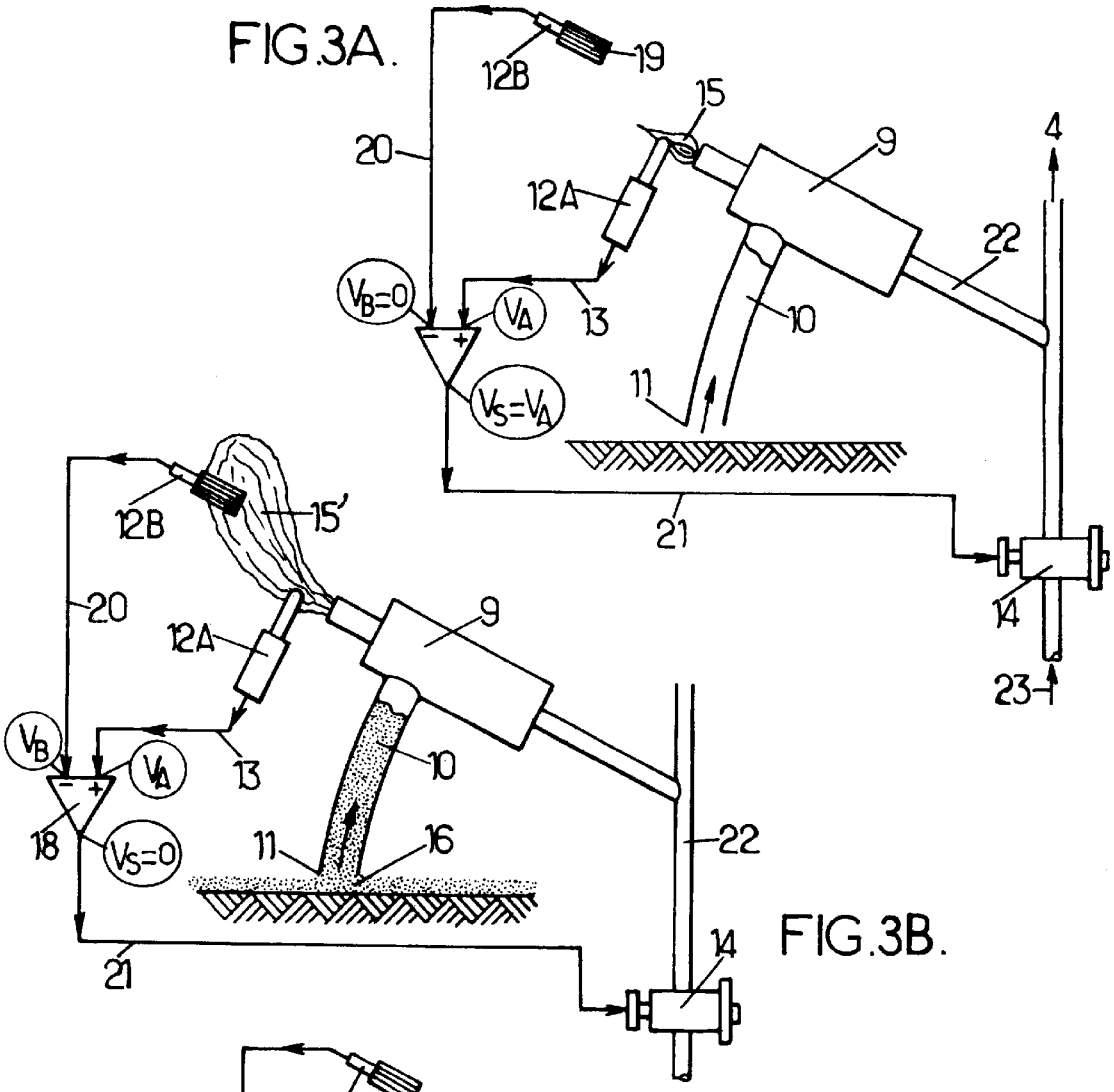
FIG.3B.
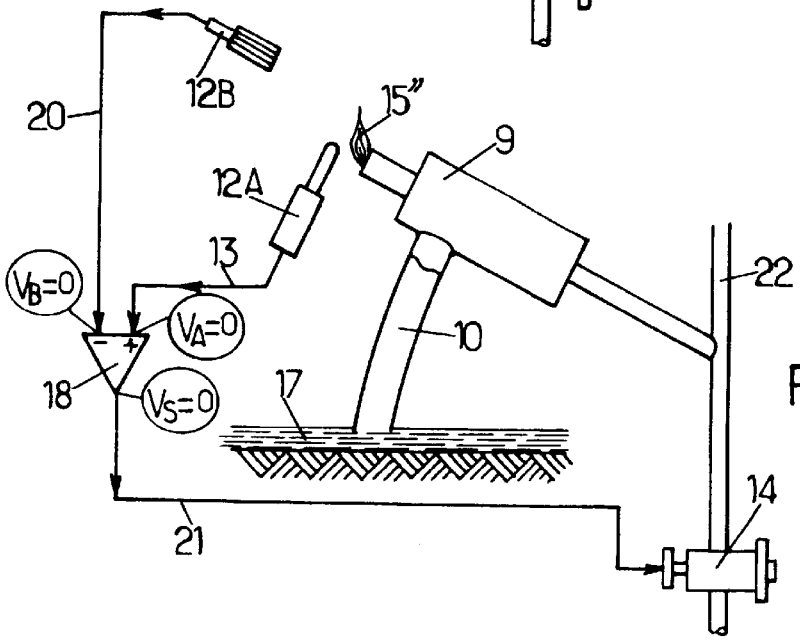
FIG.3C.

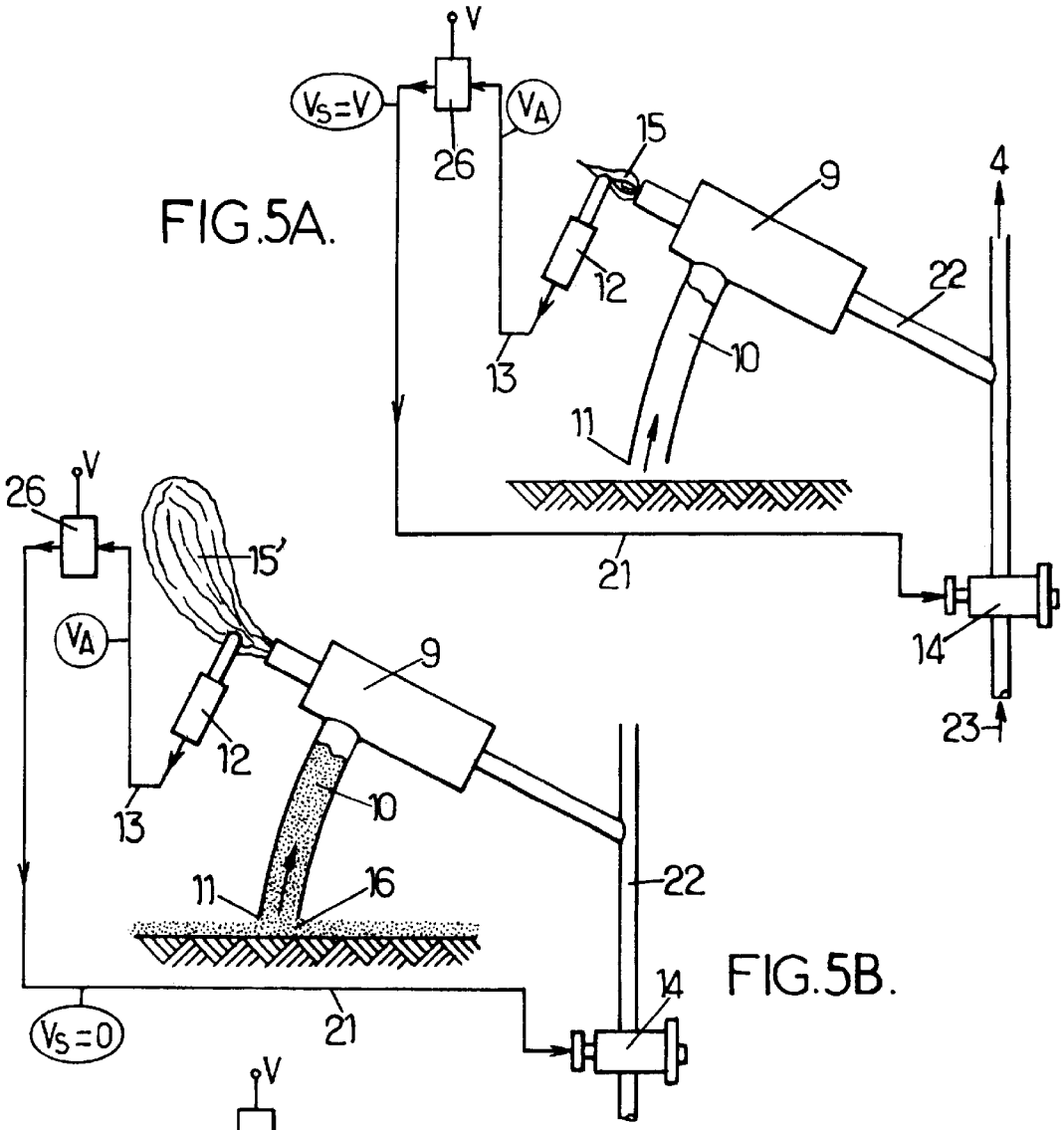
FIG.5A.
FIG.5B.
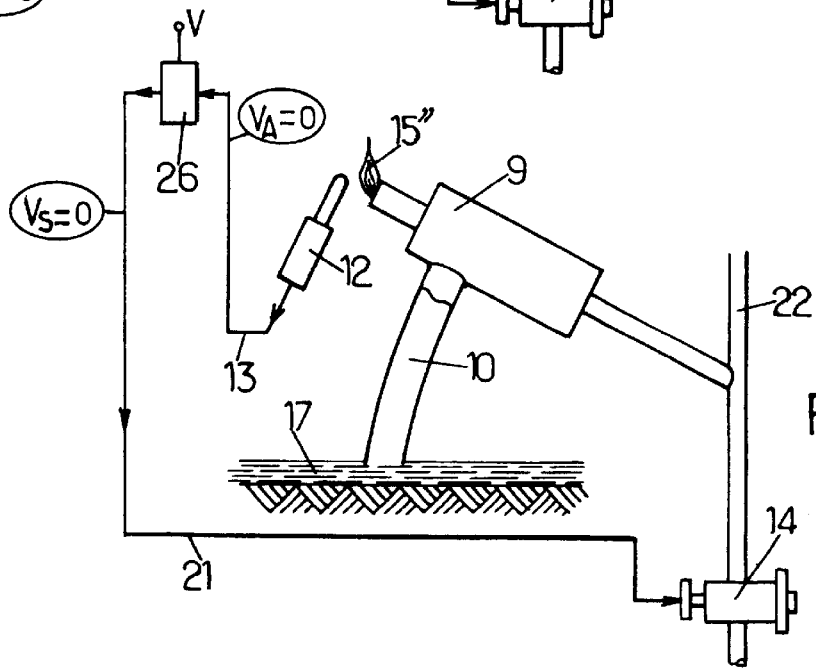
FIG.5C.

V
26
27
15
9
4
12
22
10
Vs=V
VA
13
11
21
14
23
15'

Vs=0
16

GAS APPLIANCE WITH A BURNER IN THE LOWER PART, EQUIPPED WITH SAFETY MEANS, AND RESULTING WATER HEATER

FIELD OF THE INVENTION

The present invention relates to improvements afforded to gas appliances, and especially to gas water heaters, comprising a gas burner placed in the lower part of the said appliance and in the vicinity of a surface underlying this appliance, which further comprises an atmosphere control pilot light connected to the gas supply to the burner and means for detecting the temperature of the flame of the said pilot light which are operationally coupled to means for cutting off the gas supply to the main burner.

DESCRIPTION OF THE PRIOR ART

In some countries (especially North America: USA and Canada), gas water heaters of this type equip not only individual dwellings, but also industrial premises such as garages or workshops for repairing motor vehicles. In the latter type of installation, very many accidents due to ignition of petrol vapours unintentionally sprayed in the immediate vicinity of the base of the appliances, where the gas burner is found, have been noted.

To prevent such accidents, the appliances have been modified and fitted with fireproof netting in front of the primary air intakes needed for the operation of the burner. However, this solution is not satisfactory: given the dirty and dusty environment in the locations where the appliances are sited, the netting, which must have fairly fine mesh, clogs up relatively quickly and obstructs the primary air intake: this then results in a high increase in the CO content and a serious risk of asphyxia.

In other cases, the appliances have been made with sealed combustion chambers supplied with primary air by vertical pipes, the inlet orifices of which are raised with respect to the surface (in general the ground) on which the appliance rests and on which there is a risk of the liquid petrol being spilt with the formation, above, of stagnant petrol vapours. Here again this solution is not satisfactory because it involves modifying the basic structure of the appliances.

SUMMARY OF THE INVENTION

The aim of the invention is to provide an improved solution which is particularly efficient from the point of view of safety, which is suitable for a dirty environment, which requires no modification to the basic structure of the appliances and which, as a result, can be applied not only to new appliances, but also to already existing appliances by means of a simple modification, and, finally, which does not involve too high an additional cost.

To these ends, a gas appliance as mentioned in the preamble is characterized, being arranged according to the invention, in that the atmosphere control pilot light comprises a primary air inlet orifice connected to which is a tube, the free orifice of which is located below the gas burner.

By virtue of such an arrangement, the gas supply to the main burner is interrupted when the temperature detection means detect cooling of the flame of the pilot light which is caused by gas enrichment of the mixture (presence of vapours in the primary air or obstruction of the air intake by a liquid phase, especially liquid petrol).

In a preferred manner, the free orifice of the said tube is located in the immediate proximity of the surface supporting the appliance, that is to say that it is located as close as possible to this surface in order to ensure that the safety device will act as soon as the vapours and/or a liquid (petrol) appear on the underlying surface, while however leaving a passage which is large enough so that sufficient primary air can be sucked up and that the pilot light can operate normally in the absence of petrol. In particular, in a normal installation mode, the appliance rests on the ground and the free end of the tube is then located in the immediate proximity of the ground.

In a simple exemplary embodiment, the means for detecting the temperature of the flame comprise at least one thermocouple which is placed in the axis and downstream of the pilot light and the output voltage of which controls the means for cutting off the gas supply to the main burner.

In an efficient embodiment making it possible to overcome the influence of the ambient temperature, the means for detecting the temperature of the flame comprise two thermocouples, it being possible for the second of the thermocouples to be offset laterally with respect to the axis of the pilot light, which are suitable for generating a non-zero output voltage in the presence of a flame resulting from correct operation of the pilot light and an output voltage which is substantially zero in the absence of a flame or in the presence of an abnormal flame due to gas enrichment of the mixture, and in that the means for cutting off the gas supply are of the type which open in the presence of a non-zero control voltage and which close in the presence of a zero control voltage.

In another embodiment, which makes it possible to obtain enough voltage to excite the means for controlling the gas supply to the main burner, provision is made for the means of detecting the temperature of the flame to further comprise a thermal microswitch, which may be placed laterally offset with respect to the axis of the pilot light, which has an input terminal connected to an electrical supply and an output terminal connected to the means for controlling the gas supply to the main burner, and which has an excitation input terminal connected to the abovementioned thermocouple (12), for the said microswitch to be suitable for generating an output voltage equal to the supply voltage when it is excited by the thermocouple put in the presence of a flame resulting from correct operation of the pilot light and a zero output voltage in the absence of a flame or in the presence of an abnormal flame due to gas enrichment of the mixture, and for the means for controlling the gas supply to be of the type which open in the presence of a non-zero control voltage and which close in the presence of a zero control voltage.

In a variant embodiment suitable for preventing inadvertent shutdown of the main burner, provision is made for a moveable screen sensitive to a temperature increase to be inserted between the second thermocouple or the microswitch and the pilot light, such that the said screen remains in position in the presence of a stable or briefly elongated flame so as to prevent inadvertent triggering of the said second thermocouple or microswitch and to prevent the gas supply being inadvertently cut off, but that the said screen is moved under the action of heating due to a flame which is elongated in a lasting manner and then sets the said second thermocouple or microswitch in the presence of the said elongated flame so that it cuts off the gas supply. The screen may then advantageously consist of a bimetallic strip.

As emerges clearly from the above explanations, the provisions of the invention have a particularly beneficial, although not exclusive, application in gas water heaters.

BRIEF DESCRIPTION OF THE DRAWINGS

The invention will be better understood on reading the following detailed description of a preferred embodiment of the invention given solely by way of non-limiting example. In this description, reference is made to the appended drawings in which:

FIGS. 3A to 3C are diagrams illustrating another advantageous embodiment of the safety means incorporated in the appliance of FIG. 1 and shown in three different functional configurations, respectively;

FIGS. 5A to 5C are diagrams illustrating yet another advantageous embodiment of the safety means incorporated in the appliance of FIG. 1 and shown in three different operational configurations, respectively.

DETAILED DESCRIPTION OF THE INVENTION

Figure 1:
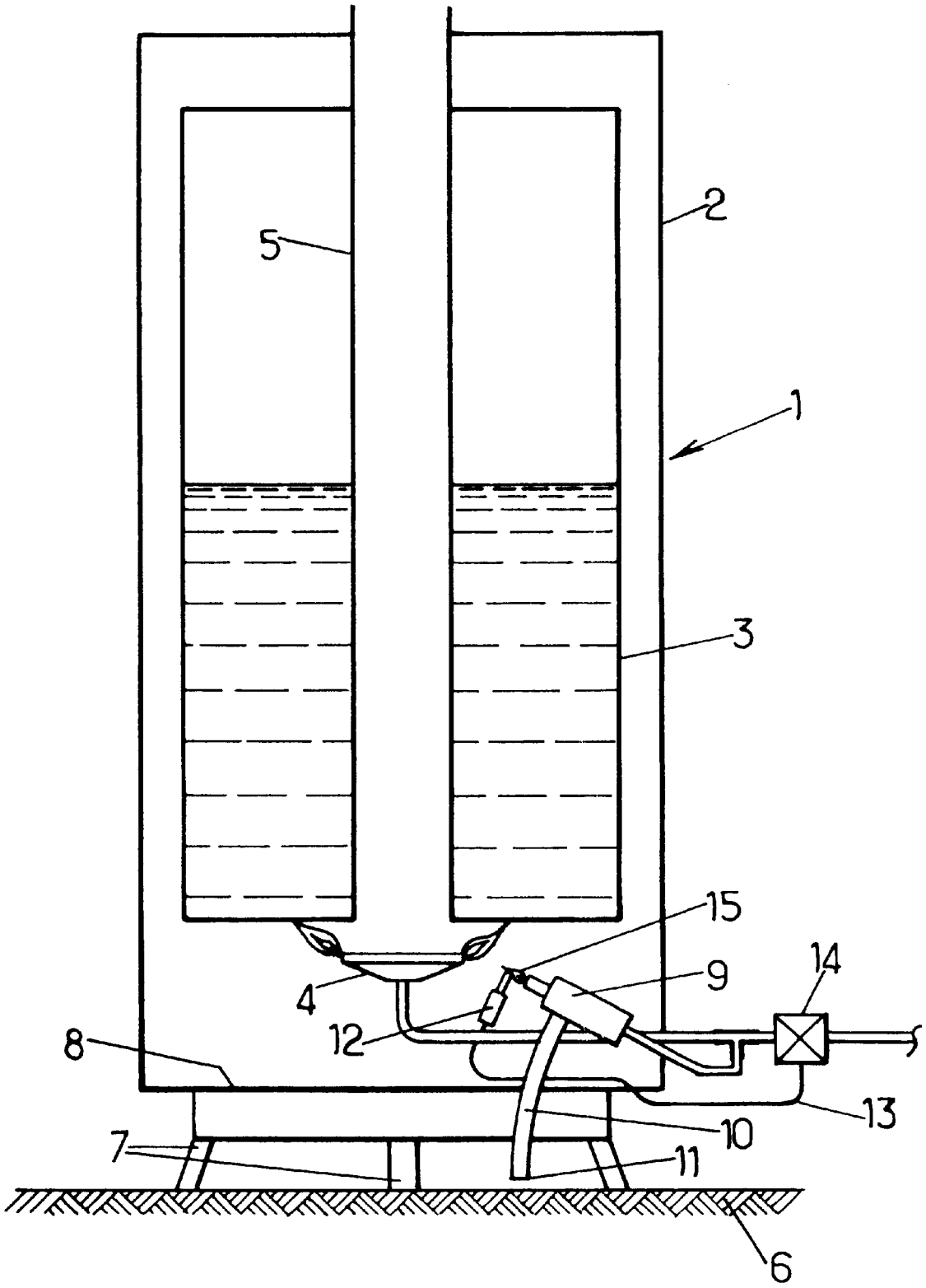
FIG. 1 is a schematic view in section of a gas appliance made according to the invention.

With reference first of all to FIG. 1, a gas appliance of the type aimed at by the invention is shown in the form of a gas water heater 1, since this is a preferred, although not exclusive, application of the provisions of the invention.

The water heater 1 comprises, very succinctly, an outer jacket or housing 2 forming a casing and containing a water tank 3 at the base of which is located at least one gas burner 4. A chimney 5 for discharging combustion gases, which passes through the water tank 3 vertically and opens to the atmosphere at the top of the housing 2, extends above the burner 4.

The housing 2 is mounted or supported in such a way that its bottom is in the vicinity of an underlying surface 6. For example, in practice, the housing 2 rests on a support surface such as the ground 6 by means of an underframe 7 of relatively low height such that the gas burner 4 is relatively close to this support surface.

The bottom 8 of the housing 2 is open, or has openings for the free passage of the ambient air in the direction of the burner 4 (primary air).

It is understood consequently that, if a liquid, such as petrol, which easily evaporates and easily ignites is sprayed on the ground 6 in the immediate vicinity of the appliance 1 or thereunder, all the conditions combine so that the petrol vapours, or even the liquid petrol drops are carried with the primary air to the burner and dangerously change the operating conditions thereof.

In the basic structure which has just been described, the appliance 1 further comprises a safety device having an atmosphere control pilot light 9, connected to the gas supply to the burner 4, which comprises a primary air inlet orifice connected to which is an air intake tube 10, the free end 11 of which is located below the gas burner 4. Furthermore, means 12 for detecting the temperature of the flame 15 of the pilot light 9 are added to the pilot light 9, these means 12 being operationally coupled 13 to means 14 (for example a motor-operated valve) for cutting off the gas supply to the main burner 4.

In a simple and effective manner, the means 12 for detecting the flame temperature of the pilot light 9 consist of a thermocouple, the threshold of which is set in relation to the temperature of the flame 15 of the pilot light in normal operation, that is to say when the pilot light is supplied with pure primary air.

For the operation of the safety device to be effective, it is desirable that it interrupts the operation of the burner 4 as soon as the first petrol vapours or the first traces of liquid petrol appear. For this, it is preferable that the orifice 11 of the air intake tube 10 is located as close as possible to the support surface 6, while however checking that there is a large enough free passage so that, in normal operation, a satisfactory quantity of air can easily enter the tube, in order for the burner 4 to be normally supplied with primary air and to operate correctly.

The safety device implemented according to the invention operates as follows.

In normal operation (FIG. 2A), the pure air is sucked through the orifice 11 of the tube 10 and the pilot light 9 delivers a flame 15 directed axially and having a predetermined temperature which is detected by the thermocouple 12. The latter, taking into account its threshold setting, delivers a signal which, via the line 13, controls the way in which the means 14 for cutting off the gas supply to the main burner 4 are kept open.

In the case where petrol vapours 16 appear (FIG. 2B, in which the petrol vapours are shown diagrammatically by dots), these vapours 16 are carried with the air through the orifice 11 of the tube 10. The presence of petrol vapours in the pilot light 9 leads to a change in the air to gas ratios with a noticeable reduction in the volume of air. This results in considerable cooling of the temperature of the flame 15' of the pilot light. This cooling of the flame is immediately detected by the thermocouple 12 which then emits a signal thus controlling the closure of the means 14 for cutting off the gas supply to the main burner 4.

In the presence of liquid petrol 17 (FIG. 2C, in which the liquid petrol is shown diagrammatically by dashes), this liquid obstructs the orifice 11 of the tube 10 and air no longer reaches the pilot light 9. Deprived of oxygen, the flame 15" of the pilot light loses its shape and no longer heats the thermocouple 12. Immediately, the latter emits a signal controlling the closure of the means 14 for cutting off the gas supply to the main burner 4.

In a beneficial manner, the means 14 for cutting off the gas supply may consist of a multifunctional valve with electromagnetic control which is sensitive to the electromotive force generated by the thermocouple 12.

Figure 2A:
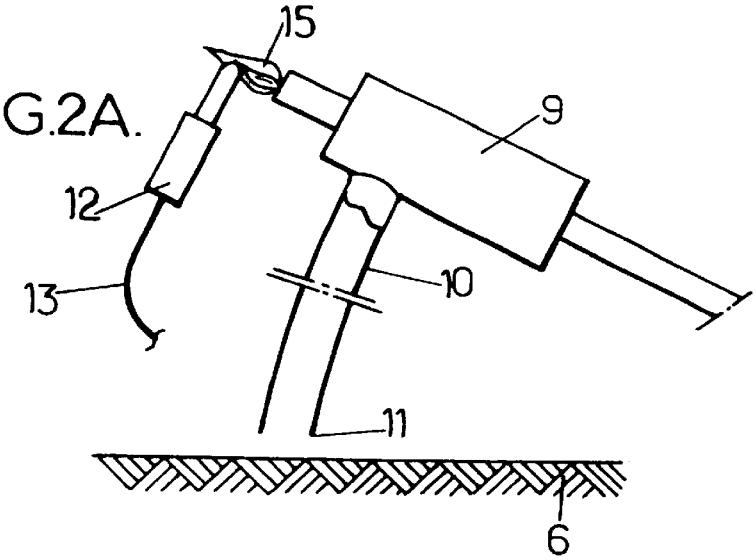
FIGS. 2A to 2C are diagrams illustrating the safety means incorporated according to the invention in the appliance of FIG. 1 and shown in three different operational configurations, respectively.
Figure 2B:
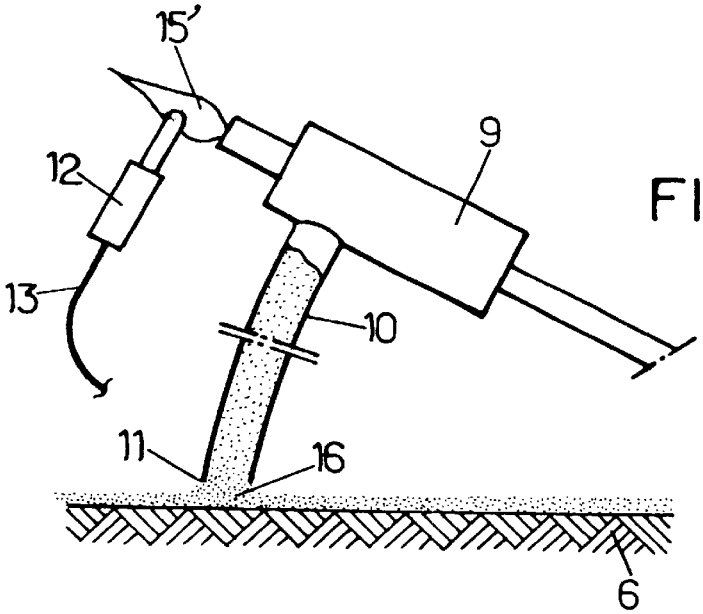
Figure 2C:
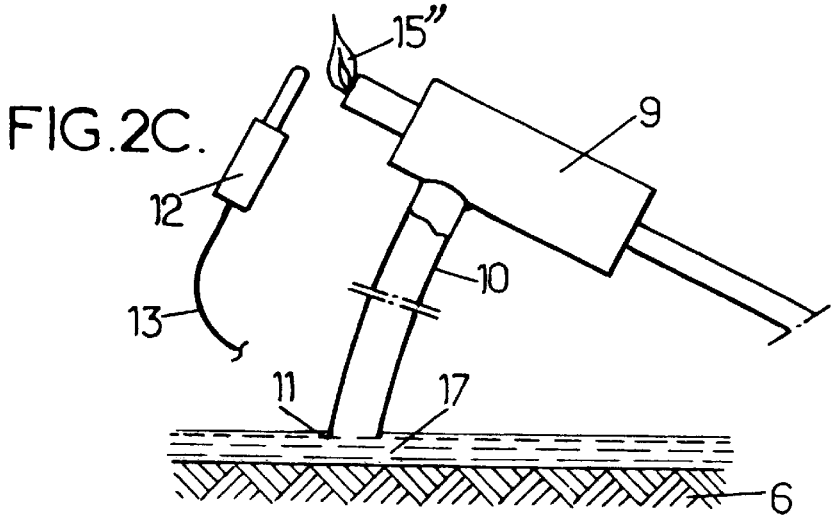

The embodiment with a single thermocouple 12 illustrated in FIGS. 2A to 2C has a very high sensitivity to variations in ambient temperature. Such an arrangement, which has the advantage of simplicity, may give complete satisfaction in an environment with a stable temperature. In contrast, in an environment with a variable temperature, it is preferable to have recourse to the arrangement illustrated in FIGS. 3A and 3C which then proves to be more advantageous since, operating in a differential manner, it overcomes thermal drifts.

In this improved arrangement, the thermocouple 12A is retained, which thermocouple is placed in the axis of the pilot light and the electrical output of which is connected at 13 to the positive input (or non-inverting input) of an electronic comparator device 18.

A second thermocouple 12B is added (which may advantageously be fitted with a ceramic protective sleeve 19 to deaden heat convection made possible, for example, by movement of the flame 15 of the pilot light effected by an air current) which is placed further away and offset with respect to the axis of the pilot light. The electrical output of the thermocouple 12B is connected at 20 to the negative input (or inverting input) of the comparator device 18.

Finally, the output of the comparator device 18 is connected at 21 to the control for the means 14 for cutting off the gas supply, advantageously consisting of an electromagnetic control valve, which are inserted into the pipe 22 for supplying the gas burner 4 with gas. In a preferred manner, as a safety measure, the valve 14 has positive opening control, that is to say that it is in the open position when a non-zero voltage is applied to its control input and that it is automatically returned to the closed position in other cases (zero control voltage; absence of control voltage).

The operation of this embodiment is as follows.

In normal operation (FIG. 3A), the primary air is correctly sucked towards the pilot light 9 through the tube 10 and the flame 15, having a normal temperature, bathes the sensitive part of the thermocouple 12A; the latter then delivers a positive voltage $V_A$ (for example, typically 9 mV) applied to the positive input of the comparator device 18. As for the thermocouple 12B, it is not touched by the flame and it delivers a voltage $V_B$ which is substantially zero to the inverting input of the comparator device 18. Under these conditions, the comparator device 18 delivers an output voltage $V_S$ which is substantially equal to the input voltage $V_A$ present on its positive terminal and an output voltage which is applied to the input terminal for controlling the valve 14 and which keeps the latter in the open position. The gas therefore flows (arrow 23) in the direction of the burner 4.

If petrol vapors 16 are present at the orifice 11 of the tube 10 and are sucked into the latter (FIG. 3B), the result is a cooling of the flame which extends and softens: henceforth, the flame 15' not only bathes the thermocouple 12A, but it also bathes the thermocouple 12B. Under these conditions, the two thermocouples deliver substantially identical respective voltages $V_A$ and $V_B$ (for example, typically 0.9 mV) which are applied to the non-inverting and inverting inputs, respectively, of the comparator device 18. The result of this is that the output voltage $V_S$ of the comparator device 18 is substantially zero. Since the control of the valve 14 is no longer excited, the valve closes and interrupts the gas supply to the burner 4.

In the case of the presence of a liquid (especially liquid petrol) obstructing the tube 10 (FIG. 3C), the flame deprived of air shortens and is deflected (15"), such that it no longer bathes either of the two thermocouples 12A, 12B. The latter deliver output voltages $V_A$ and $V_B$ which are zero; the comparator device 18 itself therefore also delivers an output voltage which is zero. Since the control of the valve 14 is not excited, the valve closes and interrupts the gas supply to the burner 4.

In the presence of a variation of the ambient temperature leading to a drift (assumed to be substantially identical) of the output voltages of the two thermocouples 12A, 12B, the differential function introduced by the comparator device eliminates the drift terms and the output signal $V_S$ is insensitive to this thermal influence.

Figure 4:
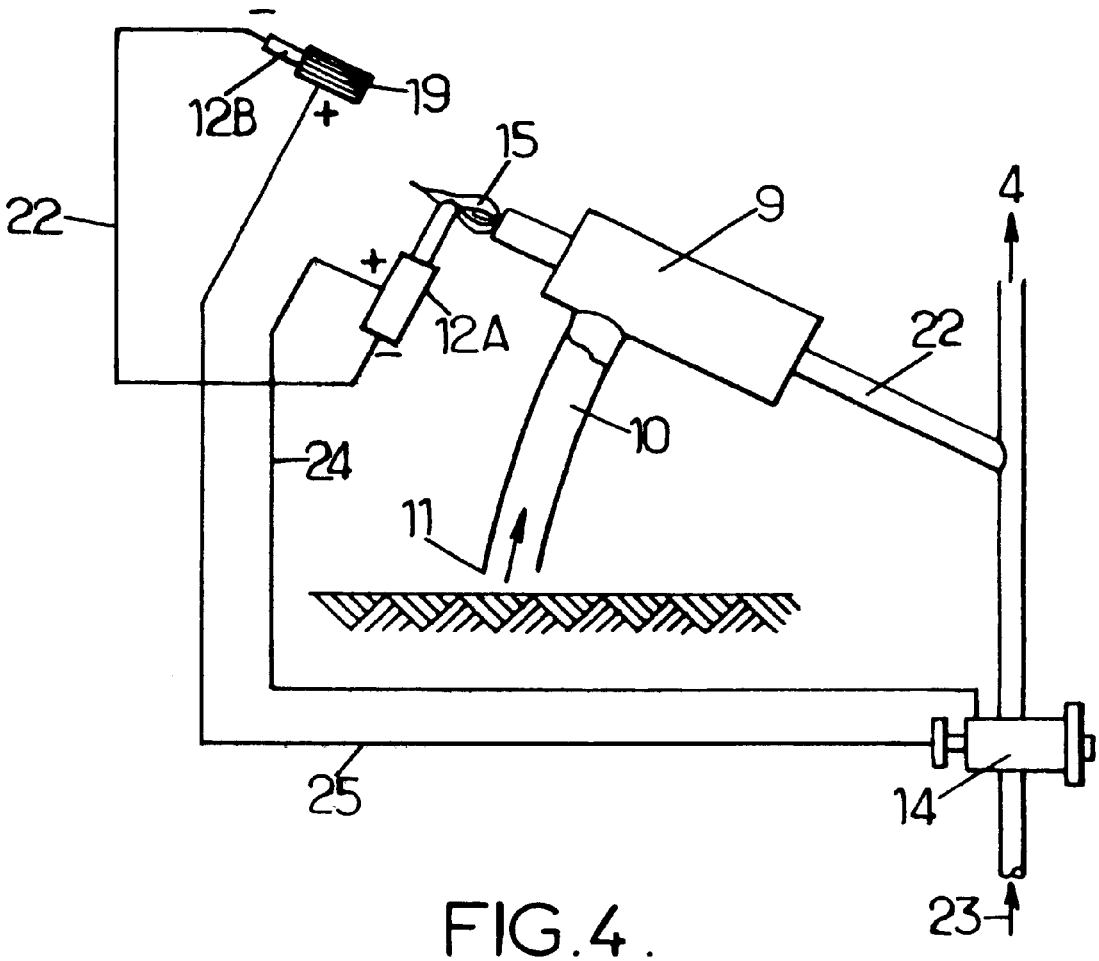
FIG. 4 is a diagram illustrating a very simple and very economical variant embodiment constituting an alternative to the set-up of FIG. 3A.

A control identical to that which has just been described with respect to FIGS. 3A to 3D could be constructed by using means arranged in a much simpler manner, as illustrated in FIG. 4. This simple set-up calls for the same thermocouples 12A and 12B as above, but the latter are connected to each other in series and in opposition so that their respective signals are subtracted from each other. Thus the two respective negative terminals of the two thermocouples are joined to each other (line 22), while the positive terminals of the main thermocouple 12A and of the thermocouple 12B, respectively, are connected (24, 25) to the electromagnetic control of the valve 14. The combination of the signals from the thermocouples 12A, 12B, and therefore the opening/closing conditions of the valve 14 are the same as those indicated above with respect to FIGS. 3A to 3C.

Although the means described above with respect to FIGS. 3A–3C are entirely satisfactory as to operational safety, they have however the drawback that the output voltage $V_S$ delivered by the thermocouples is relatively small (for example typically about 5 to 10 mV). The result of this is that, for reliable operation, the means 14 for cutting off the gas supply which are of the electromagnetic type must be equipped with a coil which is high-performance, well designed and therefore expensive. Some manufacturers, who wish to reduce the manufacturing costs of the appliances as much as possible, have expressed the desire to use coils which are low-performance, but inexpensive, which require a substantially higher excitation voltage than that likely to be delivered by thermocouples.

To satisfy this requirement together with the same safety requirements as above, it is possible to resort to the set-up illustrated in FIGS. 5A–5C, in which the same numerical references have been adopted as in FIGS. 3A–3C to denote identical members. To the thermocouple 12 has been added a thermal microswitch 26 (that is to say with thermal contact inversion) which can be placed offset laterally with respect to the axis of the pilot light 9. The output of the thermocouple 12 is connected via the line 13 to an excitation input of the microswitch 26. Moreover, the microswitch 26 has a main input terminal connected to a voltage source V and an output which is connected via the line 21 to the means 14 for controlling cut off of the gas supply.

In normal operation (FIG. 5A), the flame 15 bathes the sensitive part of the thermocouple 12 without reaching the microswitch 26. The voltage $V_A$ delivered by the thermocouple 12 keeps the microswitch 26 in a state of conduction between its main input and its output such that the output voltage $V_S$ is equal to the voltage V of the source. Therefore the means 14 for controlling the gas supply are excited by the voltage V, which means, as indicated above, are kept in the open position (supplying the main burner) in the presence of an excitation voltage. By virtue of this arrangement, the means 14 for controlling the gas supply may be excited by a voltage V of any value, even a high value, independently of the voltage $V_A$ delivered by the thermocouple. The microswitch 26 then behaves like a relay.

If petrol vapours 16 are present at the orifice 16 of the tube 10 and are sucked into the latter (FIG. 5B), this results in cooling of the flame which extends and softens: the flame 15' bathes the thermocouple 12, but also reaches the microswitch 26. The latter, having a thermal effect, switches under the effect of the increase in temperature and opens the electrical circuit for exciting the means 14 for controlling the gas supply ($V_S$=0): the valve closes and interrupts the gas supply to the main burner.

In the case of the presence of a liquid (especially liquid fuel) obstructing the orifice 10 (FIG. 3C), the flame deprived of air shortens and is deflected (flame 15"): the thermocouple 12, no longer being heated, then delivers a voltage $V_A$ which is zero or, at the very least, too small to excite the microswitch 26. The latter is then positioned in the open position ($V_S$=0) and the means 14 for controlling the gas supply, no longer being excited, put the valve in the closed position, interrupting the gas supply to the main burner.

In the embodiments which have just been described with regard to FIGS. 3A–3C and 5A–5C, the second thermocouple 12B or the microswitch 26 is sensitive to an extension of the flame and then controls the closure of the valve supplying the main burner. To prevent inadvertent stopping of the operation of the appliance in the case of a brief disturbance resulting in a fleeting extension of the flame of the pilot light, it is proposed to resort to the arrangement illustrated in FIGS. 6A–6C (which corresponds to the embodiment of FIGS. 5A–5C, but which could be extended to other embodiments, especially that of FIGS. 3A–3C).

Provision is made to insert, between the pilot light 9 and the microswitch 26, a moveable screen 27 which is only removed in the presence of a non-fleeting temperature increase caused by a flame extended in a lasting manner because of an anomaly in supplying the pilot light. A screen 27 of this sort may advantageously consist, in a simple manner, of a bimetallic strip as illustrated in FIG. 6A.

The bimetallic strip forming the screen 27 is arranged such that, during normal operation of the pilot light, it is not reached by the flame 15 bathing the thermocouple 12, but is however in line with the flame 15 beyond the latter. The microswitch 26 then operates under the conditions explained above with regard to FIG. 5A.

If, for an unexpected reason, the flame extends briefly (flame $\mathbf{15}_1$ in FIG. 6B), it certainly reaches the screen 27; however, the latter does not have the time to be heated and does not move/become deformed. The microswitch 26, thus protected, does not switch and maintains the continuity of the circuit exciting the means 14 for controlling the gas supply to the main burner (arrow 23).

Figures 6A, 6B, 6C:
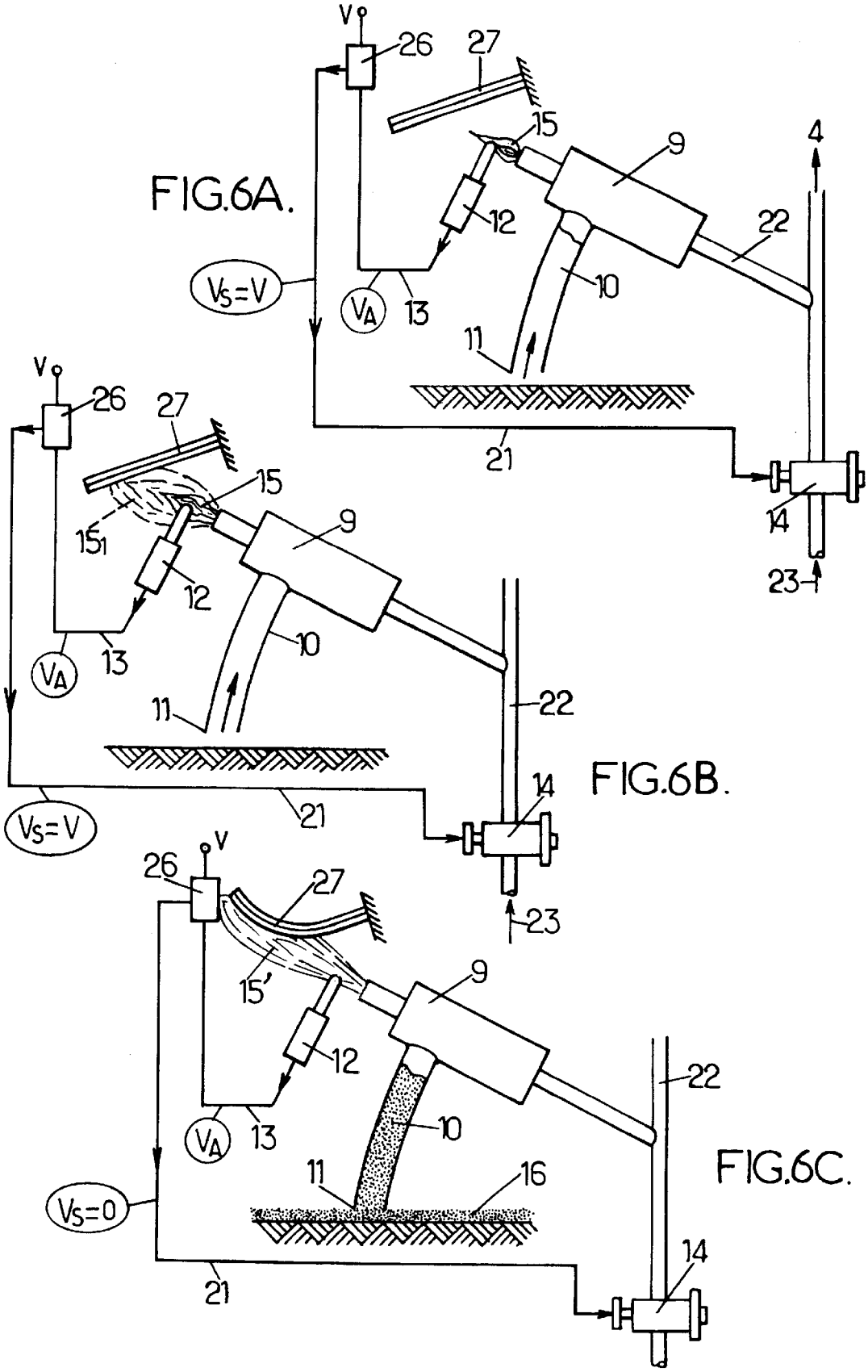
FIGS. 6A to 6C are diagrams illustrating a beneficial variant embodiment of the means implemented in FIGS. 3A–3C and 5A–5C.

In contrast, in the presence of a flame 15' extended in a lasting manner because of the presence of fuel vapours in the air inlet tube 10, the bimetallic strip constituting the screen 27 is deformed, thereby clearing a passage to the microswitch 26 which itself also becomes exposed to the flame 15' (FIG. 6C). The heated microswitch 26 cuts the circuit exciting the means 14 for controlling the gas supply and the valve closes, under the conditions explained above with regard to FIG. 5B.

What is claimed is:

1. A gas appliance, comprising:

a lower part of the appliance;

a gas burner placed in the lower part of the appliance and in the vicinity of a surface underlying the appliance;

means for cutting off the gas supply to the burner;

an atmosphere control pilot light connected to the gas supply to the burner, wherein the atmosphere control pilot light includes a primary air inlet orifice to which an air suction tube is connected with one end thereof, and wherein the other end of said air suction tube is located below the gas burner and in the immediate proximity of the surface underlying the appliance; and means for detecting the temperature of the flame of the pilot light and operationally coupled to the means for cutting off the gas supply to the burner, whereby the gas supply to the burner is interrupted when the temperature detection means detect cooling of the flame of the pilot light which is caused by gas enrichment of the mixture.

2. The appliance according to claim 1, wherein said appliance is adapted to rest on the ground, and wherein said other end of said air suction tube is adapted to be located in the immediate proximity of the ground.

3. The appliance according to claim 4, wherein said means for detecting the temperature of the flame includes at least one thermocouple which is placed in the axis and downstream of the pilot light and the output voltage of which controls the means for cutting off the gas supply to the burner.

4. The appliance according to claim 3, wherein said means for detecting the temperature of the flame includes two thermocouples which are suitable for generating a non-zero output voltage in the presence of a flame resulting from correct operation of the pilot light and an output voltage which is substantially zero in the absence of a flame or in the presence of an abnormal flame due to gas enrichment of the mixture, and wherein the means for cutting off the gas supply is of the type which open in the presence of a non-zero control voltage and which close in the presence of a zero control voltage.

5. The appliance according to claim 4, wherein the second of said thermocouples is offset laterally with respect to the axis of the pilot light.

6. The appliance according to claim 4, wherein said means for detecting the temperature of the flame includes a thermal microswitch, which has an input terminal connected to an electrical supply and an output terminal connected to the means for controlling the gas supply to the main burner, and which has an excitation input terminal connected to said thermocouple, wherein said microswitch is suitable for generating an output voltage equal to the supply voltage when it is excited by the thermocouple put in the presence of a flame resulting from correct operation of the pilot light and a zero output voltage in the absence of a flame or in the presence of an abnormal flame due to gas enrichment of the mixture, and wherein said means for controlling the gas supply are of the type which open in the presence of a non-zero control voltage and which close in the presence of a zero control voltage.

7. The appliance according to claim 4, wherein a movable screen sensitive to a temperature increase is inserted between said second thermocouple and the pilot light, such that said screen remains in position in the presence of a stable or briefly elongated flame so as to prevent inadvertent triggering of said second thermocouple and to prevent the gas supply being inadvertently cut off, but that said screen is moved under the action of heating due to a flame which is elongated in a lasting manner and then sets said second thermocouple in the presence of said elongated flame so that it cuts off the gas supply.

8. The appliance according to claim 4, wherein a moveable screen consisting of a bimetallic strip sensitive to a temperature increase is inserted between said second thermocouple and the pilot light, such that said screen remains in position in the presence of a stable or briefly elongated flame so as to prevent inadvertent triggering of said second thermocouple and to prevent the gas supply being inadvertently cut off, but that said screen is moved under the action of heating due to a flame which is elongated in a lasting manner and then sets said second thermocouple in the presence of said elongated flame so that it cuts off the gas supply.

9. The appliance according to claim 6, wherein a moveable screen sensitive to a temperature increase is inserted between said microswitch and the pilot light, such that said screen remains in position in the presence of a stable or briefly elongated flame so as to prevent inadvertent triggering of said microswitch and to prevent the gas supply being inadvertently cut off, but that said screen is moved under the action of heating due to a flame which is elongated in a lasting manner and then sets said microswitch in the presence of said elongated flame so that it cuts off the supply.

10. The appliance according to claim 6, wherein a moveable screen consisting of a bimetallic strip sensitive to a temperature increase is inserted between said microswitch and the pilot light, such that said screen remains in position in the presence of a stable or briefly elongated flame so as to prevent inadvertent triggering of said microswitch and to prevent the gas supply being inadvertently cut off, but that said screen is moved under the action of heating due to a flame which is elongated in a lasting manner and then sets said microswitch in the presence of said elongated flame so that it cuts off the gas supply.

11. The appliance according to claim 1, wherein the gas appliance is a water heater.

* * * * *